US010950202B2

(12) United States Patent
Choi et al.

(10) Patent No.: US 10,950,202 B2
(45) Date of Patent: Mar. 16, 2021

(54) DISPLAY APPARATUS AND METHOD OF DRIVING THE SAME

(71) Applicant: Samsung Display Co., Ltd., Yongin-si (KR)

(72) Inventors: Nam-Gon Choi, Yongin-si (KR); Hoi Sik Moon, Hwaseong-si (KR); Jai-Hyun Koh, Yongin-si (KR); Yoongu Kim, Seoul (KR); Namjae Lim, Gwacheon-si (KR); Seung Young Choi, Yongin-si (KR); JaeSung Bae, Suwon-si (KR); Taehyeong An, Hwaseong-si (KR); Byoung Seok Yoo, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/601,382

(22) Filed: Oct. 14, 2019

(65) Prior Publication Data

US 2020/0118525 A1 Apr. 16, 2020

(30) Foreign Application Priority Data

Oct. 15, 2018 (KR) ..... 10-2018-0122565

(51) Int. Cl.
*G09G 5/10* (2006.01)

(52) U.S. Cl.
CPC ..... *G09G 5/10* (2013.01); *G09G 2310/027* (2013.01); *G09G 2320/0626* (2013.01)

(58) Field of Classification Search
CPC combination set(s) only.
See application file for complete search history.

(56) References Cited

U.S. PATENT DOCUMENTS

| | | | | |
|---|---|---|---|---|
| 9,711,111 | B2 | 7/2017 | Atkins | |
| 2011/0148941 | A1* | 6/2011 | Kim | G09G 3/3426 345/690 |
| 2012/0086713 | A1* | 4/2012 | Cho | G09G 3/003 345/419 |

FOREIGN PATENT DOCUMENTS

| | | | |
|---|---|---|---|
| KR | 10-2011-0036422 | A | 4/2011 |
| KR | 10-1433106 | B1 | 9/2014 |
| KR | 10-1675849 | B1 | 11/2016 |

* cited by examiner

*Primary Examiner* — Deeprose Subedi
(74) *Attorney, Agent, or Firm* — Lewis Roca Rothgerber Christie LLP

(57) ABSTRACT

A display apparatus includes a local dimmer, an image compensator, a display panel and a light source. The local dimmer is configured to generate a dimming signal representing a degree of dimming for a light source block based on input image data. The image compensator is configured to determine a grayscale gain based on input grayscale value of the input image data and the dimming signal and to compensate luminance of the input image data based on the grayscale gain. The display panel is configured to display an image based on the compensated input image data. The light source is configured to provide light to the display panel based on the dimming signal.

13 Claims, 11 Drawing Sheets
(4 of 11 Drawing Sheet(s) Filed in Color)

FIG. 2

100

| | | | | | | | |
|---|---|---|---|---|---|---|---|
| DB11 | DB12 | DB13 | DB14 | DB15 | DB16 | DB17 | DB18 |
| DB21 | DB22 | DB23 | DB24 | DB25 | DB26 | DB27 | DB28 |
| DB31 | DB32 | DB33 | DB34 | DB35 | DB36 | DB37 | DB38 |
| DB41 | DB42 | DB43 | DB44 | DB45 | DB46 | DB47 | DB48 |
| DB51 | DB52 | DB53 | DB54 | DB55 | DB56 | DB57 | DB58 |
| DB61 | DB62 | DB63 | DB64 | DB65 | DB66 | DB67 | DB68 |

FIG. 3

BLU

| | | | | | | | |
|---|---|---|---|---|---|---|---|
| LB11 | LB12 | LB13 | LB14 | LB15 | LB16 | LB17 | LB18 |
| LB21 | LB22 | LB23 | LB24 | LB25 | LB26 | LB27 | LB28 |
| LB31 | LB32 | LB33 | LB34 | LB35 | LB36 | LB37 | LB38 |
| LB41 | LB42 | LB43 | LB44 | LB45 | LB46 | LB47 | LB48 |
| LB51 | LB52 | LB53 | LB54 | LB55 | LB56 | LB57 | LB58 |
| LB61 | LB62 | LB63 | LB64 | LB65 | LB66 | LB67 | LB68 |

DISPLAY APPARATUS AND METHOD OF DRIVING THE SAME

CROSS-REFERENCE TO RELATED APPLICATION

This application claims priority to and the benefit of Korean Patent Application No. 10-2018-0122565, filed on Oct. 15, 2018 in the Korean Intellectual Property Office (KIPO), the content of which is incorporated herein in its entirety by reference.

BACKGROUND

1. Field

An embodiment of the present inventive concept relates to a display apparatus and a method of driving the display apparatus, and more particularly to a display apparatus for enhancing a display quality of an image using a local dimming method and a method of driving the display apparatus.

2. Description of the Related Art

Using a local dimming method, a degree of light intensity is determined corresponding to a luminance of a block of input image data to reduce power consumption of a display apparatus.

When the display apparatus is driven according to the local dimming method, a total luminance of a display panel is decreased. The input image data may be increased to compensate for the decreased luminance. When the input image data is compensated using a high gain, a detailed pattern of a high grayscale image (gray level image) may not be displayed due to grayscale saturation (gray level saturation). In addition, when the input image data is compensated using a low gain, luminance of the image may not be sufficient.

SUMMARY

Aspects of some exemplary embodiments of the present inventive concept are directed toward a display apparatus compensating input image data using gains varied according to grayscale values (gray level values) to enhance a display quality when using a local dimming method.

Aspects of some exemplary embodiments of the present inventive concept are directed toward a method of driving the display apparatus.

In an exemplary embodiment of a display apparatus according to the present inventive concept, the display apparatus includes a local dimmer, an image compensator, a display panel and a light source. The local dimmer is configured to generate a dimming signal representing a degree of dimming for a light source block based on input image data. The image compensator is configured to determine a grayscale gain based on input grayscale value of the input image data and the dimming signal and to compensate luminance of the input image data based on the grayscale gain. The display panel is configured to display an image based on the compensated input image data. The light source is configured to provide light to the display panel based on the dimming signal.

In an exemplary embodiment, the local dimmer may be configured to generate first compensation information corresponding to a first gain graph having gains varied according to light profile values.

In an exemplary embodiment, as the light profile value increases, the gain may decrease in the first gain graph.

In an exemplary embodiment, the image compensator may be configured to generate a plurality of selecting compensation information groups corresponding to a plurality of selecting gain graphs having gains varied according to the light profile values for a plurality of selecting grayscale values.

In an exemplary embodiment, as the light profile value increases, the gain may decrease in each of the plurality of selecting gain graphs.

In an exemplary embodiment, a gain of a first selecting gain graph corresponding to a first selecting grayscale value for a first light profile value may be greater than a gain of a second selecting gain graph corresponding to a second selecting grayscale value greater than the first selecting grayscale value for the selecting grayscale value.

In an exemplary embodiment, the image compensator may be configured to generate a plurality of additional compensation information groups corresponding to a plurality of compensation gain graphs corresponding to the plurality of the selecting grayscale values. For the same light profile value and for the same grayscale value, multiplication of the gain of the first gain graph and the gain of the compensation gain graph is equal to the gain of the selecting gain graph.

In an exemplary embodiment, when the input grayscale value is between a first selecting grayscale value and a second selecting grayscale value, the input grayscale value is x, the first selecting grayscale value is s1, the second selecting grayscale value is s2 and a rate of change of grayscale value is e, $e=(x-s1)/(s2-s1)$.

In an exemplary embodiment, when a first compensation gain of a first compensation gain graph for the first light profile value is a, a second compensation gain of a second compensation gain graph for the first light profile value is b, and a rate of change of compensation is f, $f=(a-b)*e$. When a rate of compensation of a pixel for the first light profile value and the input grayscale value is g, $g=b+f$. When a final compensated value for the first light profile value and the input grayscale value is h, $h=g*x$.

In an exemplary embodiment, the display apparatus may further include a gate driver configured to output a gate signal to the display panel, a data driver configured to output a data voltage to the display panel, a driving controller configured to control a driving timing of the gate driver and the data driver and a host configured to output the input image data and an input control signal to the driving controller. The host may include the local dimmer, and the driving controller may include the image compensator.

In an exemplary embodiment of a method of driving a display apparatus, the method includes generating a dimming signal representing a degree of dimming of a light source block based on input image data, determining a grayscale gain based on input grayscale value of the input image data and the dimming signal, compensating luminance of the input image data based on the grayscale gain, displaying an image based on the compensated input image data and providing light to a display panel based on the dimming signal.

In an exemplary embodiment, the generating the dimming signal may include generating first compensation information corresponding to a first gain graph having gains varied according to light profile values.

In an exemplary embodiment, as the light profile value increases, the gain may decrease in the first gain graph.

In an exemplary embodiment, the determining the grayscale gain may include generating a plurality of selecting compensation information groups corresponding to a plurality of selecting gain graphs having gains varied according to the light profile values for a plurality of selecting grayscale values.

In an exemplary embodiment, as the light profile value increases, the gain may decrease in each of the plurality of selecting gain graphs.

In an exemplary embodiment, a gain of a first selecting gain graph corresponding to a first selecting grayscale value for a first light profile value may be greater than a gain of a second selecting gain graph corresponding to a second selecting grayscale value greater than the first selecting grayscale value for the selecting grayscale value.

In an exemplary embodiment, the determining the grayscale gain may further include generating a plurality of additional compensation information groups corresponding to a plurality of compensation gain graphs corresponding to the plurality of the selecting grayscale values. For the same light profile value and for the same grayscale value, multiplication of the gain of the first gain graph and the gain of the compensation gain graph is equal to the gain of the selecting gain graph.

In an exemplary embodiment, when the input grayscale value is between a first selecting grayscale value and a second selecting grayscale value, the input grayscale value is x, the first selecting grayscale value is s1, the second selecting grayscale value is s2 and a rate of change of grayscale value is e, $e=(x-s1)/(s2-s1)$.

In an exemplary embodiment, when a first compensation gain of the first compensation gain graph for the first light profile value is a, a second compensation gain of the second compensation gain graph for the first light profile value is b, a rate of change of compensation is f, $f=(a-b)*e$. When a rate of compensation of a pixel for the first light profile value and the input grayscale value is g, $g=b+f$. When a final compensated value for the first light profile value and the input grayscale value is h, $h=g*x$.

According to the display apparatus and the method of driving the display apparatus, the light source part is driven in the local dimming method according to the input image data so that a power consumption of the display apparatus may be reduced. In addition, the input image data may be compensated using the gains varied according to the grayscale values so that a grayscale saturation in a high grayscale range (gray level range) may be reduced or prevented and a luminance in a low grayscale range (gray level range) may be sufficiently compensated. Thus, the display quality of the display panel may be enhanced in the local dimming method.

BRIEF DESCRIPTION OF THE DRAWINGS

The patent or application contains at least one drawing executed in color. Copies of this patent or patent application with color drawing(s) will be provided by the Office upon request and payment of the necessary fee.

The above and other features and advantages of the present inventive concept will become more apparent by describing in detailed exemplary embodiments thereof with reference to the accompanying drawings.

FIG. 2 is a conceptual diagram illustrating display blocks of a display panel of FIG. 1.

FIG. 3 is a conceptual diagram illustrating light source blocks of a light source part of FIG. 1.

DETAILED DESCRIPTION

Hereinafter, the present inventive concept will be explained in more detail with reference to the accompanying drawings.

Figure 1:
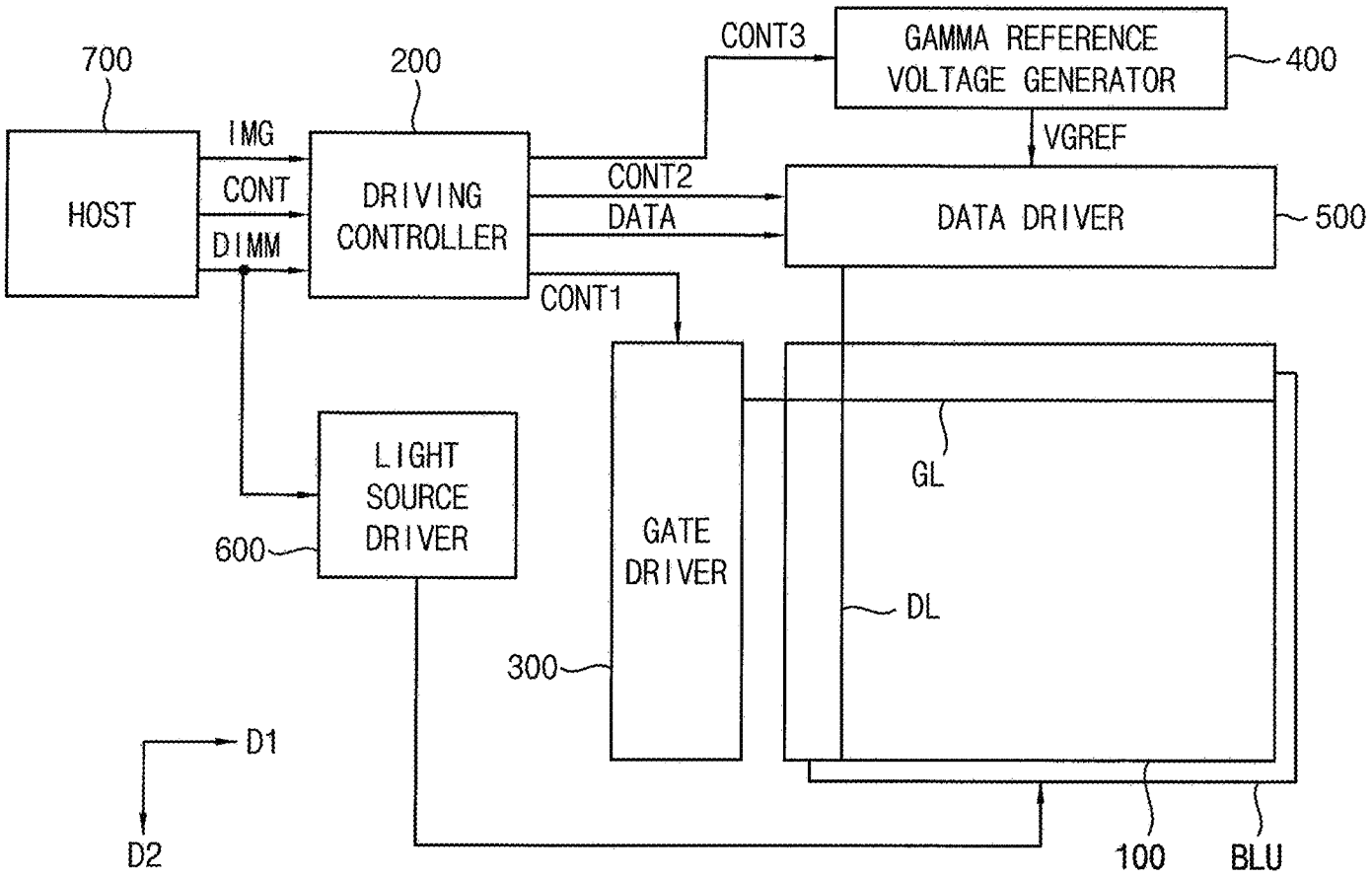
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus may include a display panel 100 and a display panel driver. The display panel driver may include a driving controller 200, a gate driver 300, a gamma reference voltage generator 400 and a data driver 500. The display apparatus may further include a light source part BLU providing light to the display panel 100 and a light source driver 600 driving the light source part BLU. The display apparatus may further include a host 700 providing input image data to the driving controller 200.

The display panel 100 may include a plurality of gate lines GL, a plurality of data lines DL, and a plurality of pixels electrically connected to the gate lines GL and the data lines DL. The gate lines GL may extend in a first direction D1 and the data lines DL may extend in a second direction D2 crossing the first direction D1.

The display panel 100 may include a first base substrate on which the gate lines GL, the data lines DL, the pixels and switching elements are disposed, a second base substrate facing the first base substrate and including a common electrode, and a liquid crystal layer disposed between the first base substrate and the second base substrate.

The driving controller 200 may receive the input image data IMG and an input control signal CONT from the host 700. For example, the input image data IMG may include red image data, green image data and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 may generate a first control signal CONT1, a second control signal CONT2, a third control signal CONT3, and a data signal DATA based on the input image data IMG and the input control signal CONT.

The driving controller 200 may generate the first control signal CONT1 for controlling an operation of the gate driver 300 based on the input control signal CONT, and may output the first control signal CONT1 to the gate driver 300. The first control signal CONT1 may include a vertical start signal and a gate clock signal.

The driving controller 200 may generate the second control signal CONT2 for controlling an operation of the data driver 500 based on the input control signal CONT, and may output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT, and may output the third control signal CONT3 to the gamma reference voltage generator 400.

The gate driver 300 may generate gate signals driving the gate lines GL in response to the first control signal CONT1 received from the driving controller 200. The gate driver 300 may output the gate signals to the gate lines GL.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF has a value corresponding to a level of the data signal DATA.

In an exemplary embodiment, the gamma reference voltage generator 400 may be in the driving controller 200, or in the data driver 500.

The data driver 500 may receive the second control signal CONT2 and the data signal DATA from the driving controller 200, and may receive the gamma reference voltages VGREF from the gamma reference voltage generator 400. The data driver 500 may convert the data signal DATA into data voltages (having or being an analog type) using the gamma reference voltages VGREF. The data driver 500 may output the data voltages to the data lines DL.

The host 700 may generate a dimming signal DIMM to control a dimming operation of the light source part BLU based on the input image data IMG. The host 700 may output the dimming signal DIMM to the light source driver 600. The dimming signal DIMM may include a dimming control signal representing a degree of dimming of each light source blocks of the light source part BLU. The host 700 may generate first compensation information corresponding to a first gain graph having gains varied according to light profile values corresponding to the degree of dimming.

The light source driver 600 may receive the dimming signal DIMM from the host 700. The light source driver 600 may convert the dimming control signal of the dimming signal DIMM into a light source driving signal. The light source driver 600 may output the light source driving signal to the light source part BLU.

The driving controller 200 may receive the dimming signal DIMM from the host 700. The driving controller 200 may compensate luminance of the input image data IMG using the first compensation information of the dimming signal DIMM.

FIG. 2 is a conceptual diagram illustrating display blocks of the display panel 100 of FIG. 1. FIG. 3 is a conceptual diagram illustrating light source blocks of the light source part BLU of FIG. 1.

Referring to FIGS. 1-3, the display panel 100 may include a plurality of display blocks DB11 to DB68 for a local dimming operation. Although the display blocks DB11 to DB68 form a six by eight matrix in the present exemplary embodiment, the present inventive concept is not limited thereto.

In addition, the light source part BLU may include a plurality of light source blocks LB11 to LB68 for the local dimming operation. Although the light source blocks LB11 to LB68 form a six by eight matrix in the present exemplary embodiment, the present inventive concept is not limited thereto. In addition, although the display blocks DB11 to DB68 and the light source blocks LB11 to LB68 correspond to each other one by one in the present exemplary embodiment, the present inventive concept is not limited thereto. Alternatively, the plural light source blocks may correspond to the single display block or the plural display blocks may correspond to the single light source block.

Using the local dimming method, when the grayscale data of the image displayed on the display block is high, the degree of dimming of the light source block corresponding to the display block may be increased. On the other hand, when the grayscale data of the image displayed on the display block is low, the degree of dimming of the light source block corresponding to the display block may be decreased.

For example, when the degree of dimming of the light source block is decreased using the local dimming method, the image may have a luminance lower than a luminance curve of the grayscale value according to a target gamma value. Thus, the input image data IMG may be compensated such that the luminance of the input image data IMG is increased.

Figure 4:
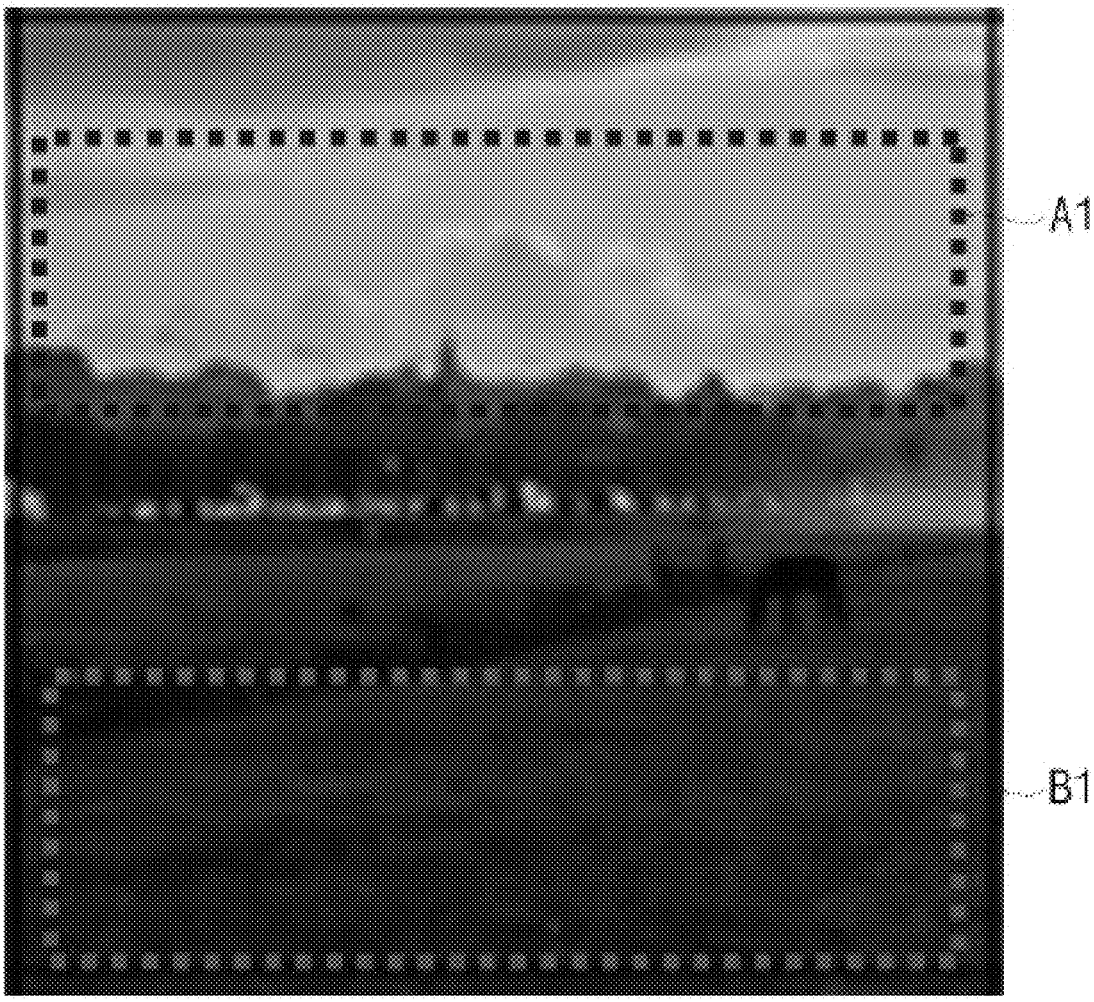
FIG. 4 is a conceptual diagram illustrating an original image corresponding to the display block of FIG. 2.
Figure 5:
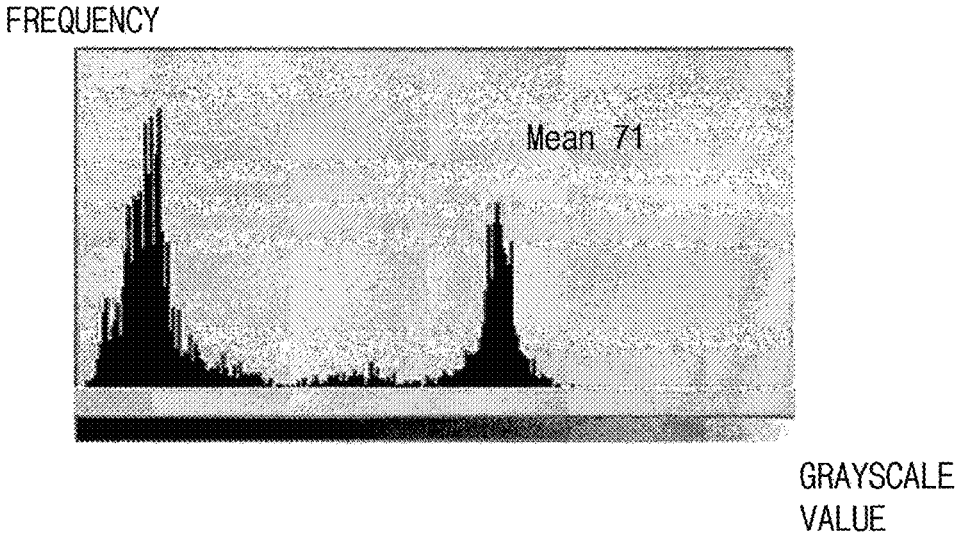
FIG. 5 is a histogram illustrating grayscale values (gray level values) of the original image of FIG. 4.
Figure 6:
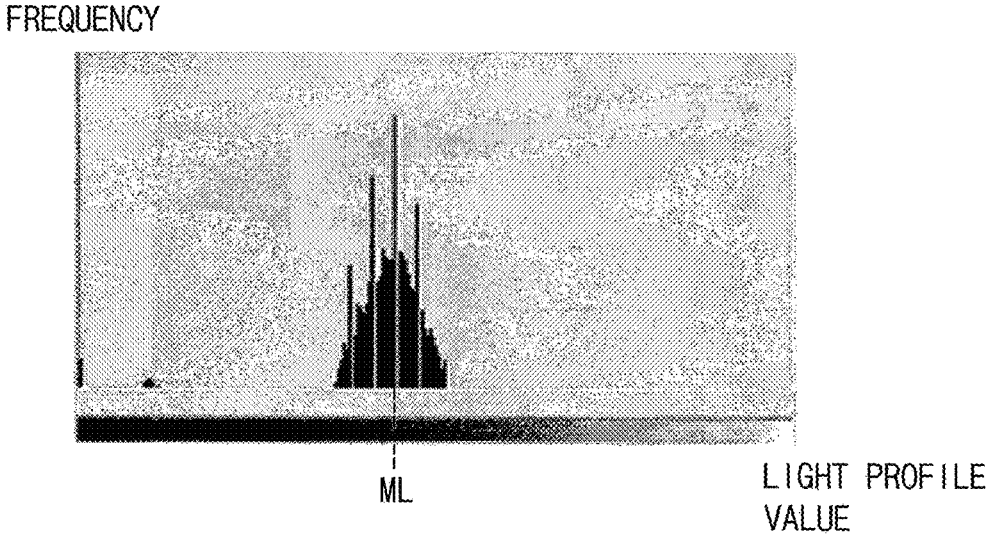
FIG. 6 is a histogram illustrating light profile values corresponding to the light source block of FIG. 3.

FIG. 4 is a conceptual diagram illustrating an original image corresponding to the display block of FIG. 2. FIG. 5 is a histogram illustrating grayscale values of the original image of FIG. 4. FIG. 6 is a histogram illustrating light profile values corresponding to the light source block of FIG. 3.

FIG. 4 represents the original image corresponding to the input image data IMG to which the local dimming method is not applied. FIG. 4 represents the image corresponding to one of the plurality of display blocks of FIG. 2.

Referring to FIG. 4, a first area A1 of FIG. 4 may have a relatively high grayscale value (gray level values) and may include a detailed shape of cloud. The first area A1 may be a detail important area. A second area B1 of FIG. 4 has a relatively low grayscale value (gray level value) and may represent a grassland. The second area B1 may not be clearly shown in low luminance so that the second area B1 may be a luminance important area.

FIG. 5 represents a histogram including accumulated counts of grayscales for pixels of an entire area of FIG. 4. The second area B1 having the relatively low luminance in FIG. 4 may correspond to a left peak portion of FIG. 5 and the first area A1 having the relatively high luminance in FIG. 4 may correspond to a right peak portion of FIG. 5. An average grayscale value (gray level value) of the original image of FIG. 4 may be 71.

FIG. 6 represents the degree ML of dimming determined based on the original image of FIG. 4. The degree ML of dimming may be called to a light profile value. When the light source block is driven by the light profile value ML and the luminance of the light source block is measured, a histogram of the measured light profile value may represent a shape of FIG. 6 which includes a highest frequency at the light profile value ML and the other frequencies of the light profile values are gradually decreased from the light profile value ML. The host 700 may output the degree ML of dimming to the light source driver 600 so that the light source driver 600 may turn on the light source block BLU by the degree ML of dimming. The host 700 may output the degree ML of dimming to the driving controller 200 so that the driving controller 200 may determine a proper grayscale gain (gray level gain).

Figure 7:
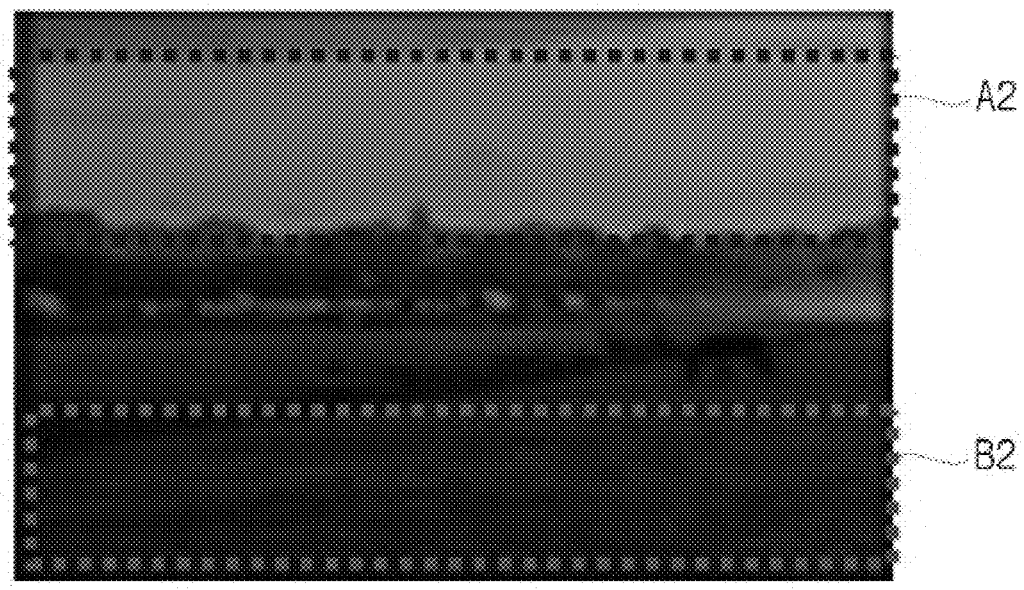
FIG. 7 is a conceptual diagram illustrating a display image according to a first comparative embodiment corresponding to the display block of FIG. 2.
Figure 8:
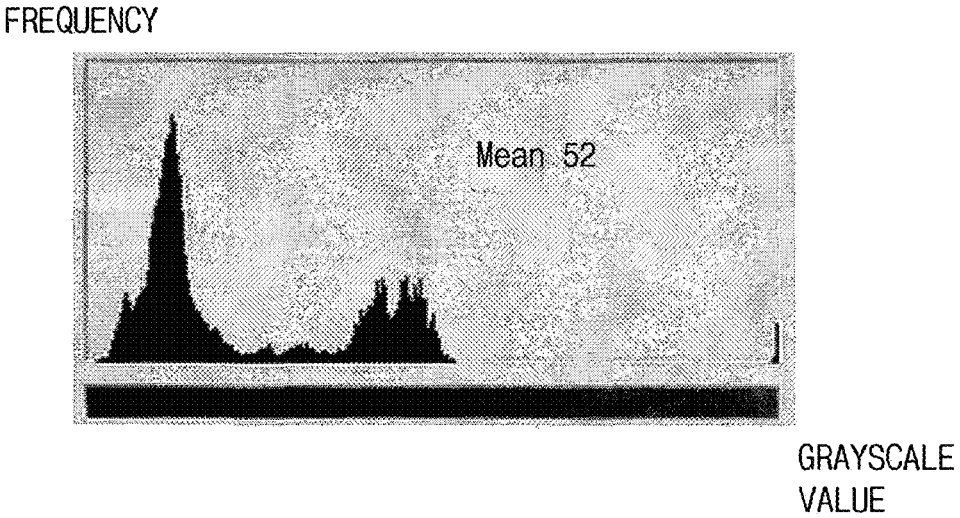
FIG. 8 is a histogram illustrating grayscale values of the display image of FIG. 7.
Figure 9:
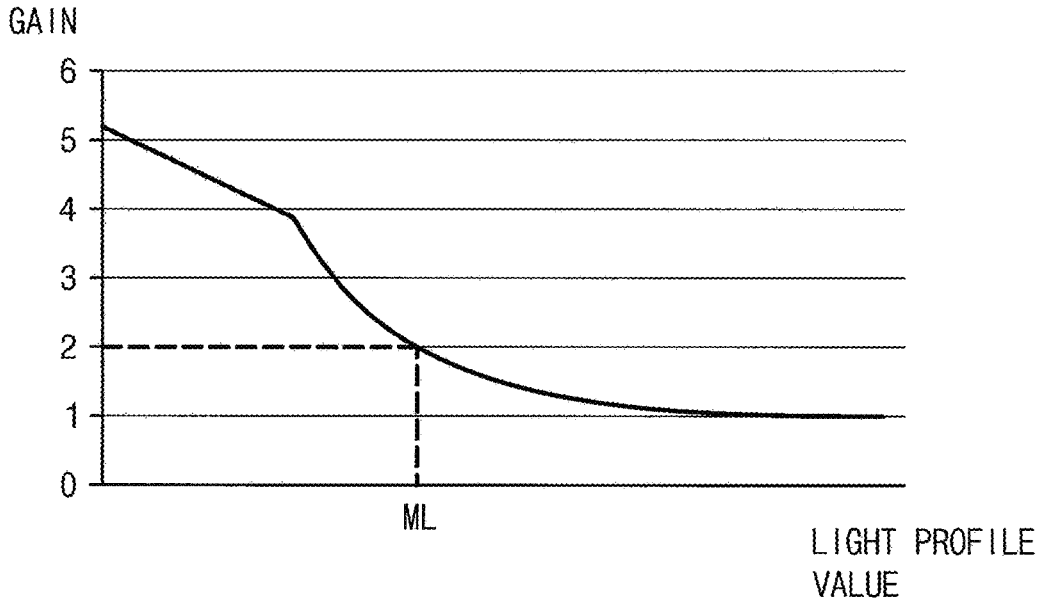
FIG. 9 is a graph illustrating a grayscale gain according to the light profile value corresponding to the display image of FIG. 7.

FIG. 7 is a conceptual diagram illustrating a display image according to a first comparative embodiment corresponding to the display block of FIG. 2. FIG. 8 is a histogram illustrating grayscale values of the display image of FIG. 7. FIG. 9 is a graph illustrating a grayscale gain according to the light profile value corresponding to the display image of FIG. 7.

FIG. 7 represents the compensated display image by multiplying a gain to the input image data IMG to compensate the decrease of the luminance of the display image due to the local dimming method.

Referring to FIGS. 7-9, the grayscale value (gray level value) of the display image of FIG. 7 may be compensated by the gain of the first gain graph of FIG. 9. The first gain graph may have gains varied according to the light profile values. As the light profile value increases, the gain may decrease in the first gain graph.

For example, the gain may be about five in a low luminance region. The gain may be about two for the light profile value ML of the original image of FIG. 4. The gain may be about one in a high luminance region. When the gain is one, the input grayscale (gray level) may be outputted without compensation.

In the first comparative embodiment, the light profile value ML of the original image is compensated by the gain of two. In addition, in the first comparative embodiment, the gain may not be varied according to the grayscale values of the pixels in the display block.

A first area A2 and a second area B2 of FIG. 7 may have different grayscale values. However, in the first comparative embodiment, the first area A2 and the second area B2 may be compensated by the same gain.

For example, when the gain is two and the input grayscale value is 50 in the display block, an output grayscale value may be 100. For example, when the gain is two and the input grayscale value is 100 in the display block, an output grayscale value may be 200. When the gain is two and the input grayscale value is 128 in the display block, an output grayscale value is 256 which exceeds the maximum grayscale value of 255. Thus, when the gain is two and the input grayscale value is 128 in the display block, the output grayscale value may be 255. Similarly, when the gain is two and the input grayscale value is greater than 128 in the display block, the output grayscale value may be saturated to 255.

When the input grayscale values of the pixels are equal to or greater than 128 at the light profile value ML, the input grayscale values are compensated to 255 resulting in a grayscale saturation (gray level saturation). Due to the grayscale saturation, the detailed representation of the cloud in the first area A2 in FIG. 7 corresponding to the first area A1 in FIG. 4 may be decreased (e.g., have less detail) compared to the cloud in the first area A1 in FIG. 4.

However, the second area B2 in FIG. 7 corresponding to the second area B1 in FIG. 4 is compensated by the gain of two so that the second area B2 in FIG. 7 may represent an appropriate luminance.

FIG. 8 represents a histogram including accumulated counts of gray levels for pixels of an entire area of FIG. 7. The second area B2 having the relatively low luminance in FIG. 7 may correspond to a left peak portion of FIG. 8 and the first area A2 having the relatively high luminance in FIG. 7 may correspond to a right peak portion of FIG. 8. The luminance of the display image of FIG. 7 is compensated with the local dimming method but the luminance of the display image of FIG. 7 may be less than the luminance of the original image of FIG. 4. An average grayscale value of the display image of FIG. 7 may be 52 which is less than 71, the average grayscale value of the original image of FIG. 4.

Figure 10:
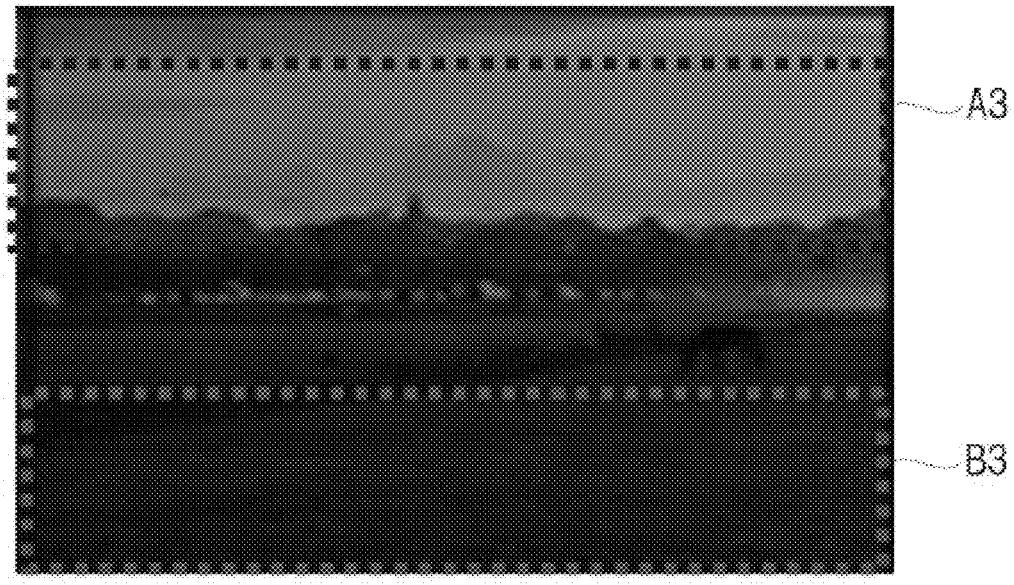
FIG. 10 is a conceptual diagram illustrating a display image according to a second comparative embodiment corresponding to the display block of FIG. 2.
Figure 11:
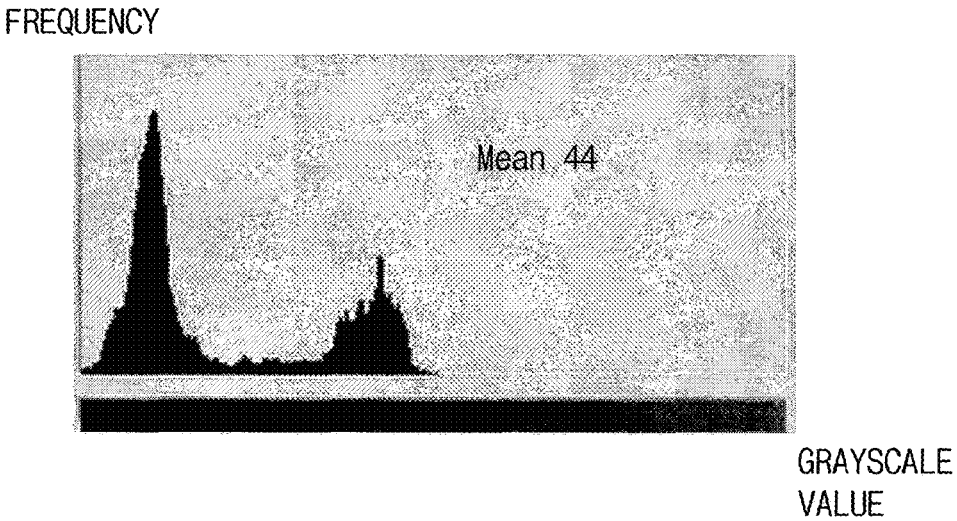
FIG. 11 is a histogram illustrating grayscale values of the display image of FIG. 10.
Figure 12:
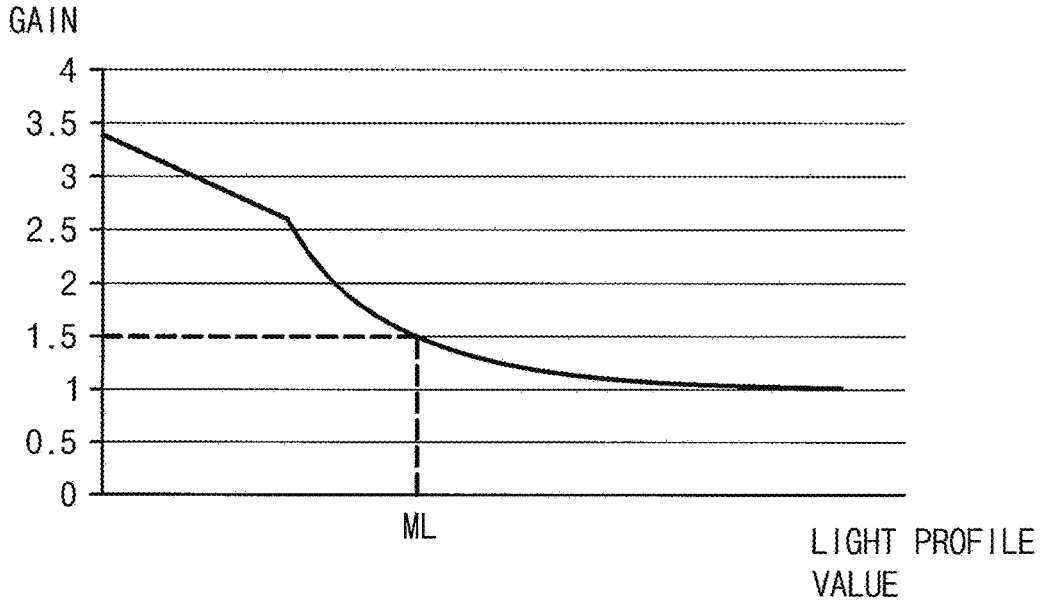
FIG. 12 is a graph illustrating a grayscale gain according to the light profile value corresponding to the display image of FIG. 10.

FIG. 10 is a conceptual diagram illustrating a display image according to a second comparative embodiment corresponding to the display block of FIG. 2. FIG. 11 is a histogram illustrating grayscale values of the display image of FIG. 10. FIG. 12 is a graph illustrating a grayscale gain according to the light profile value corresponding to the display image of FIG. 10.

FIG. 10 represents the compensated display image by multiplying a gain to the input image data IMG to compensate the decrease of the luminance of the display image due to the local dimming method.

Referring to FIGS. 10-12, the grayscale value of the display image of FIG. 10 may be compensated by the gain of the first gain graph of FIG. 12. The first gain graph may have gains varied according to the light profile values. As the light profile value increases, the gain may decrease in the first gain graph.

For example, the gain may be about 3.5 in a low luminance region. The gain may be about 1.5 for the light profile value ML of the original image of FIG. 4. The gain may be about one in a high luminance region. When the gain is one, the input grayscale (gray level) may be outputted without compensation.

In the second comparative embodiment, the light profile value ML of the original image is compensated by the gain of 1.5. In addition, in the second comparative embodiment, the gain may not be varied according to the grayscale values of the pixels in the display block.

A first area A3 and a second area B3 of FIG. 10 may have different grayscale values. However, in the second comparative embodiment, the first area A3 and the second area B3 may be compensated by the same gain.

For example, when the gain is 1.5 and the input grayscale value is 50 in the display block, an output grayscale value may be 75. For example, when the gain is 1.5 and the input grayscale value is 100 in the display block, an output grayscale value may be 150. When the gain is 1.5 and the input grayscale value is 171 in the display block, an output grayscale value is 256.5 which exceeds the maximum grayscale value of 255. Thus, when the gain is 1.5 and the input grayscale value is 171 in the display block, the output grayscale value may be 255. Similarly, when the gain is 1.5 and the input grayscale value is greater than 171 in the display block, the output grayscale value may be saturated to 255.

When the input grayscale values of the pixels are equal to or greater than 171 at the light profile value ML, the input grayscale values are compensated to 255 resulting in a grayscale saturation. Due to the grayscale saturation, the detailed representation of the cloud in the first area A3 in FIG. 10 corresponding to the first area A1 in FIG. 4 may be decreased (e.g., have less detail) compared to the cloud in the first area A1 in FIG. 4. However, a degree of the grayscale saturation of the first area A3 in FIG. 10 is less than a degree of the grayscale saturation of the first area A2 in FIG. 7 so that the detailed representation of the cloud in the first area A3 in FIG. 10 may be greater (e.g., have greater detail) than the cloud in the first area A2 in FIG. 7.

The second area B3 in FIG. 10 corresponding to the second area B1 in FIG. 4 is compensated by the gain of 1.5 so that the luminance of the second area B3 in FIG. 10 may be less than the luminance of the second area B2 in FIG. 7. The luminance of the second area B3 in FIG. 10 may be less than a desired luminance resulting in deterioration of the display quality of the display panel 100.

FIG. 11 represents a histogram including accumulated counts of grayscales (gray levels) for pixels of an entire area of FIG. 10. The second area B3 having the relatively low luminance in FIG. 10 may correspond to a left peak portion of FIG. 11 and the first area A3 having the relatively high luminance in FIG. 10 may correspond to a right peak portion of FIG. 11. The luminance of the display image of FIG. 10 is compensated with the local dimming method but the luminance of the display image of FIG. 10 may be less than the luminance of the original image of FIG. 4. An average grayscale value of the display image of FIG. 10 may be 44 which is less than 71, the average grayscale value of the original image of FIG. 4. The average grayscale value of the display image of FIG. 10 may be 44 which is less than 52, the average grayscale value of the display image of FIG. 7 since the gain of the second comparative embodiment of FIG. 10 is less than the gain of the first comparative embodiment of FIG. 7.

Figure 13:
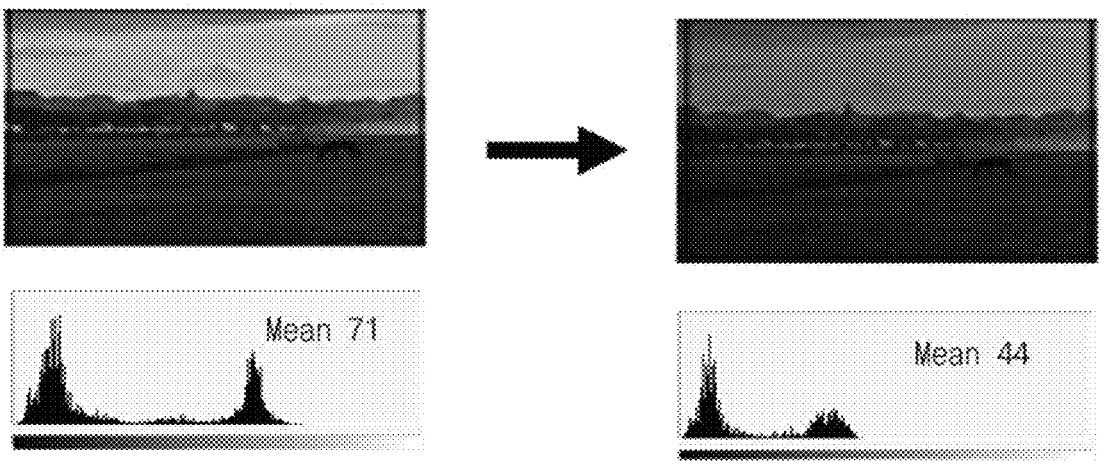
FIG. 13 is a conceptual diagram illustrating a display image and a histogram of grayscale values according to the second comparative embodiment corresponding to the display block of FIG. 2.

FIG. 13 is a conceptual diagram illustrating a display image and a histogram of grayscale values according to the second comparative embodiment corresponding to the display block of FIG. 2.

Referring to FIG. 13, when the light profile value corresponding to the display block is determined by the host 700, input grayscale values of all pixels in the display block may be compensated by the same gain. The relatively low gain is advantageous to represent the detail important area of the original image and the relatively high gain is advantageous to compensate the luminance of the luminance important area. A user or a manufacturer may determine the gain considering the display defect due to the grayscale saturation (gray level saturation) and the display defect due to the decrease of the luminance.

In FIG. 13, the original image is compensated by the gain of 1.5 of the second comparative embodiment for the light profile value ML. As explained above, the average grayscale value of the original image before local dimming is 71 and the average grayscale value of the display image compensated by the gain of 1.5 after local dimming using the light profile value ML is 44. In this case, the input grayscale values are compensated by the same gain (e.g. 1.5) regardless of the input grayscale values of the pixels in the display block.

Figure 14:
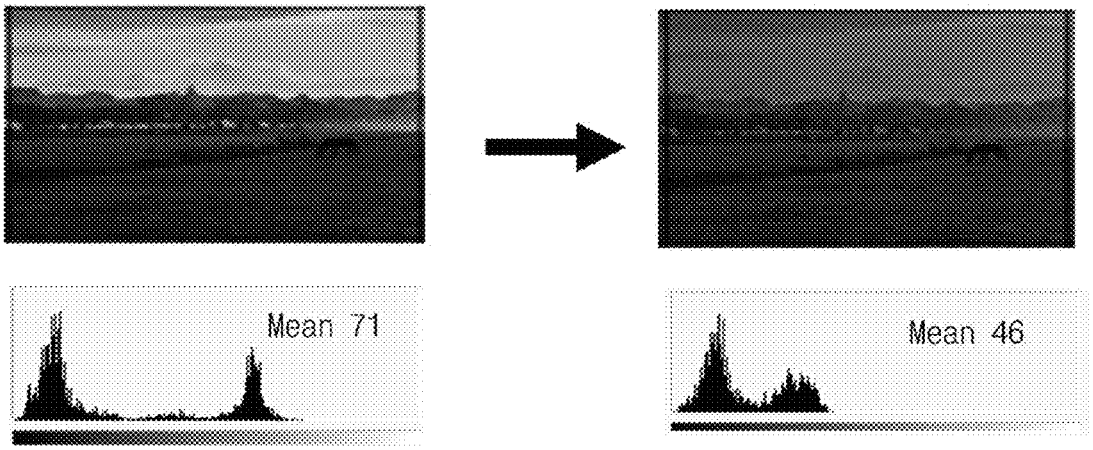
FIG. 14 is a conceptual diagram illustrating a display image and a histogram of grayscale values according to an exemplary embodiment corresponding to the display block of FIG. 2.
Figure 15:
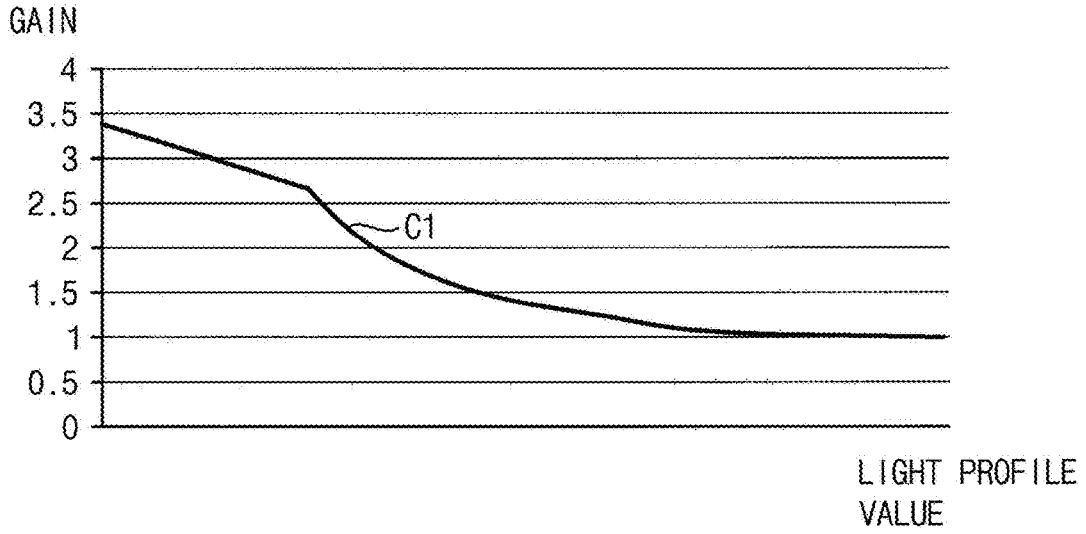
FIG. 15 is a first gain graph generated by a host of FIG. 1.
Figure 16:
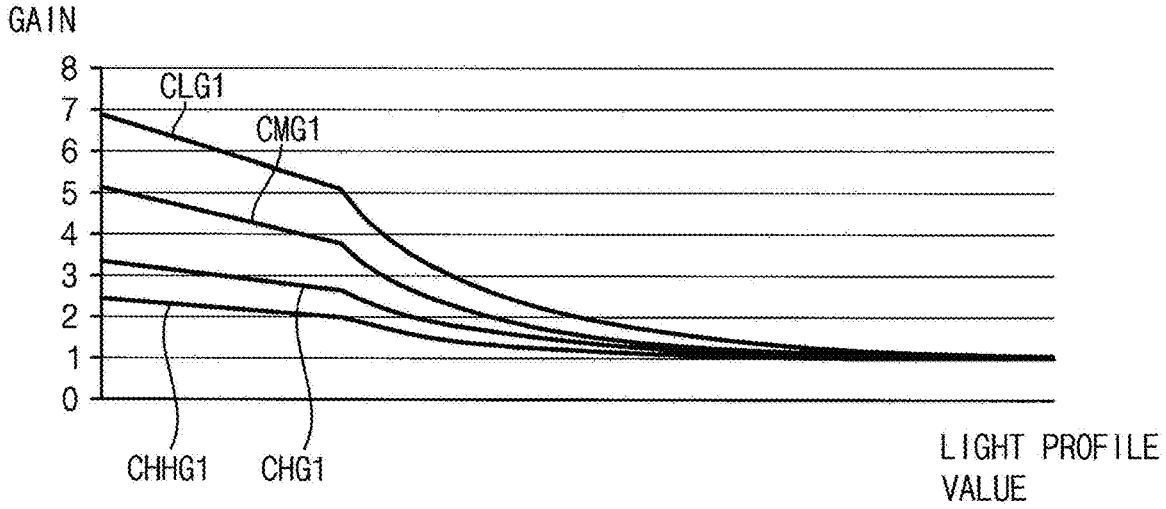
FIG. 16 is a plurality of selecting gain graphs corresponding to a plurality of selecting grayscale values generated by a driving controller of FIG. 1.
Figure 17:
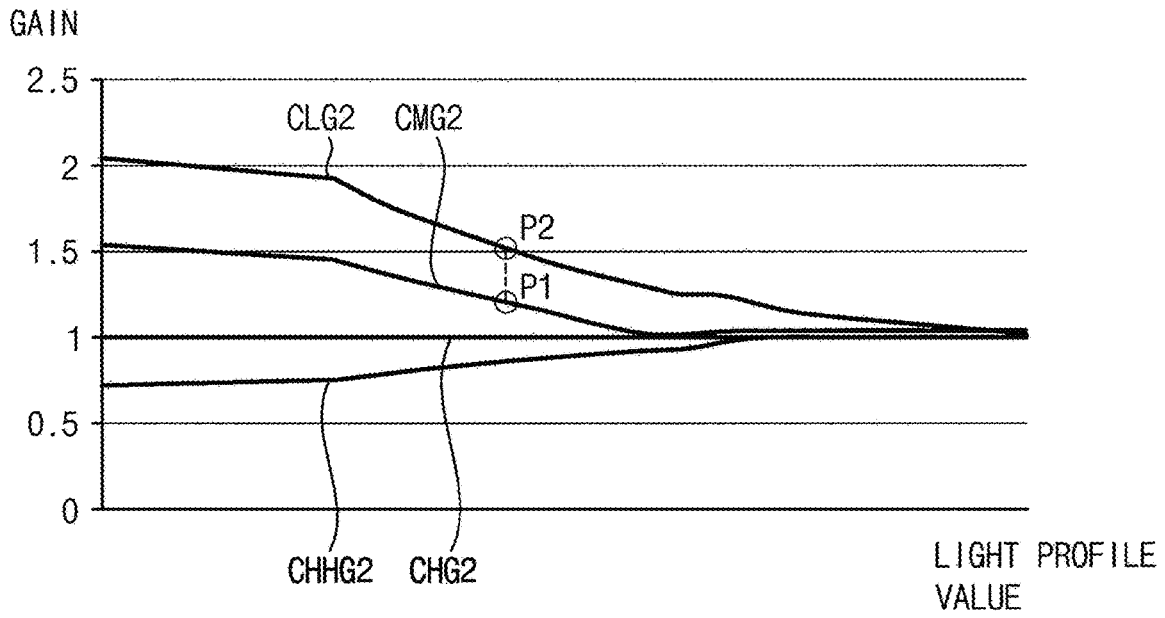
FIG. 17 is a plurality of compensation gain graphs corresponding to the plurality of the selecting grayscale values generated by the driving controller of FIG. 1.
Figure 18:
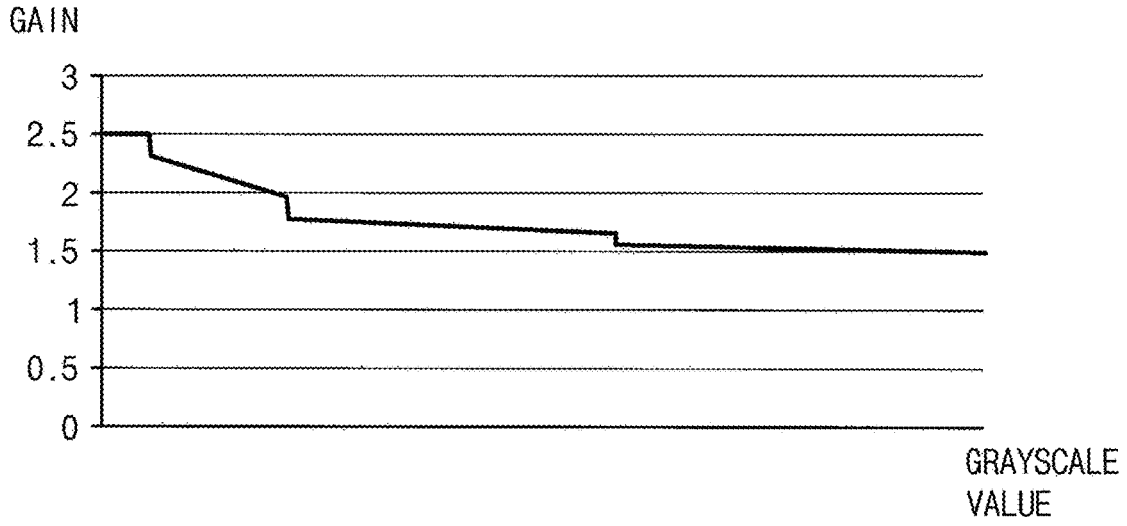
FIG. 18 is a graph illustrating a grayscale gain varied according to input grayscale values generated by the driving controller of FIG. 1.

FIG. 14 is a conceptual diagram illustrating a display image and a histogram of grayscale values according to an exemplary embodiment corresponding to the display block of FIG. 2. FIG. 15 is a first gain graph generated by a host of FIG. 1. FIG. 16 is a plurality of selecting gain graphs corresponding to a plurality of selecting grayscale values generated by a driving controller of FIG. 1. FIG. 17 is a plurality of compensation gain graphs corresponding to the plurality of the selecting grayscale values generated by the driving controller of FIG. 1. FIG. 18 is a graph illustrating a grayscale gain varied according to input grayscale values generated by the driving controller of FIG. 1.

Referring to FIGS. 14-18, the host 700 may include a local dimming part generating the dimming signal DIMM representing the degrees of the dimming for the light source blocks based on the input image data IMG. The local dimming part may output first compensation information corresponding to a first gain graph C1 having gains varied according to the light profile values. As the light profile value increases, the gain may decrease in the first gain graph C1.

The driving controller 200 may include an image compensator. The image compensator may determine the grayscale gain based on the input grayscale value of the input image data IMG and the dimming signal DIMM. The image compensator may compensate the luminance of the input image data based on the grayscale gain.

The driving controller 200 may generate a plurality of selecting compensation information groups corresponding to a plurality of selecting gain graphs CLG1, CMG1, CHG1 and CHHG1 having gains varied according to the light profile values for the selecting grayscale values. As the light profile value increases, the gain may decrease in each selecting gain graph CLG1, CMG1, CHG1 and CHHG1.

The first selecting gain graph CLG1 corresponds to a first selecting grayscale value. The first selecting grayscale value may be called to a low grayscale value. The second selecting gain graph CMG1 corresponds to a second selecting grayscale value greater than the first selecting grayscale value. The second selecting grayscale value may be called to a medium grayscale value. The third selecting gain graph CHG1 corresponds to a third selecting grayscale value greater than the second selecting grayscale value. The third selecting grayscale value may be called to a high grayscale value. The fourth selecting gain graph CHHG1 corresponds to a fourth selecting grayscale value greater than the third selecting grayscale value. The fourth selecting grayscale value may be called to an ultra-high grayscale value. The selecting gain graphs corresponding to the grayscale values except for the first to fourth selecting grayscale values may be generated by interpolation of the first to fourth selecting gain graphs CLG1, CMG1, CHG1 and CHHG1.

For the same light profile value, the gain of the first selecting gain graph CLG1 may be greater than the gain of the second selecting gain graph CMG1. For the same light profile value, the gain of the second selecting gain graph CMG1 may be greater than the gain of the third selecting gain graph CHG1. For the same light profile value, the gain of the third selecting gain graph CHG1 may be greater than the gain of the fourth selecting gain graph CHHG1. As a result, as the grayscale value decreases, the selecting gain may increase for the same light profile value. For the relatively high grayscale value, the gain is relatively low so that the grayscale saturation may be reduced or prevented and the detailed pattern may be well represented. In contrast, for the relatively low grayscale value, the gain is relatively high so that the low luminance may be well compensated.

As shown in FIG. 16, the first selecting gain graph CLG1 corresponding to the first selecting grayscale value may have a gain of seven for a low luminance region. The gain of the first selecting gain graph CLG1 gradually decrease as the luminance increases. The gain of the first selecting gain graph CLG1 may be one for a high luminance region. The fourth selecting gain graph CHHG1 corresponding to the fourth selecting grayscale value may have a gain of 2.5 for the low luminance region. The gain of the fourth selecting gain graph CHHG1 gradually decrease as the luminance increases. The gain of the fourth selecting gain graph CHHG1 may be one for the high luminance region.

The driving controller 200 may generate a plurality of additional compensation information groups corresponding to a plurality of compensation gain graphs CLG2, CMG2, CHG2 and CHHG2.

As shown in FIG. 17, the first compensation gain graph CLG2 corresponds to the first selecting grayscale value. The second compensation gain graph CMG2 corresponds to the second selecting grayscale value greater than the first selecting grayscale value. The third compensation gain graph CHG2 corresponds to the third selecting grayscale value greater than the second selecting grayscale value. The fourth compensation gain graph CHHG2 corresponds to the fourth selecting grayscale value greater than the third selecting grayscale value. The compensation gain graphs corresponding to the grayscale values except for the first to fourth selecting grayscale values may be generated by interpolation of the first to fourth compensation gain graphs CLG2, CMG2, CHG2 and CHHG2.

For the same light profile value, the gain of the first compensation gain graph CLG2 may be greater than the gain of the second compensation gain graph CMG2. As the grayscale value decreases, the compensation gain may increase for the same light profile value.

For the same light profile value and the same grayscale value, multiplication of the gain of the first gain graph Cl and the gain of the compensation gain graph CLG2, CMG2, CHG2 and CHHG2 may be the gain of the selecting gain graph CLG1, CMG1, CHG1 and CHHG1.

The first selecting gain graph CLG1 may be generated by multiplication of the first gain graph C1 and the first compensation gain graph CLG2. The second selecting gain graph CMG1 may be generated by multiplication of the first gain graph C1 and the second compensation gain graph CMG2. The third selecting gain graph CHG1 may be generated by multiplication of the first gain graph C1 and the third compensation gain graph CHG2. The fourth selecting gain graph CHHG1 may be generated by multiplication of the first gain graph C1 and the fourth compensation gain graph CHHG2.

The first gain graph C1 of FIG. 15 may be determined by the host 700 and may be transmitted from the host 700 to the driving controller 200. The driving controller 200 may generate the selecting gain graphs CLG1, CMG1, CHG1 and CHHG1 of FIG. 16 each having gain varied according to the selecting grayscale value based on the desired display image on the display panel 100. The driving controller 200 may generate compensation gain graphs CLG2, CMG2, CHG2 and CHHG2 of FIG. 17 to link the first gain graph C1 and the selecting gain graphs CLG1, CMG1, CHG1 and CHHG1 so that the display image may be compensated by the selecting gains of the selecting gain graphs CLG1, CMG1, CHG1 and CHHG1.

As shown in FIGS. 15-17, the gain of the first gain graph C1 is about 3.5 in the low luminance region, the first compensation gain of the first compensation gain graph CLG2 corresponding to the first selecting grayscale value is about two in the low luminance region and the first selecting gain of the first selecting gain graph CLG1 corresponding to the first selecting grayscale value is about seven in the low luminance region. Similarly, the gain of the first gain graph C1 is about 3.5 in the low luminance region, the second compensation gain of the second compensation gain graph CMG2 corresponding to the second selecting grayscale value is about 1.5 in the low luminance region and the second selecting gain of the second selecting gain graph CMG1 corresponding to the second selecting grayscale value is about 5.25 in the low luminance region.

If the first gain of the first gain graph C1 and the compensation gain are multiplied to the input grayscale value of the input image data IMG, then the result of the multiplication refers to that the input grayscale value is compensated by the selecting gain.

When the input grayscale value of the input image data IMG is between the first selecting grayscale value and the second selecting grayscale value, the input grayscale value is x, the first selecting grayscale value is s1, the second selecting grayscale value is s2 and a rate of change of the grayscale value is e, the rate of change of the grayscale value e may be determined as $e=(x-s1)/(s2-s1)$. The rate of change of the grayscale value e represents a relative position of the input grayscale value x between the first selecting grayscale value s1 and the second selecting grayscale value s2. The rate of change of the grayscale value e may be used for the interpolation.

When the first compensation gain of the first compensation gain graph CLG2 for the first light profile value ML is a and the second compensation gain of the second compensation gain graph CMG2 is b and a rate of change of compensation is f, the rate of change of the compensation may be determined as $f=(a-b)*e$. The rate of change of the compensation f corresponds to the rate of change of the grayscale value e. The rate of change of the grayscale value e may be represented as the rate of change of the compensation fin a domain of the compensation gain.

When a rate of compensation of a pixel for the first light profile value ML and the input grayscale value is g, the rate of compensation of the pixel g may be determined as $g=b+f$. The rate of compensation of the pixel g is sum of the compensation gain b and the rate of change of the compensation f. The rate of compensation of the pixel g refers to the compensation gain of the input grayscale level (gray level) x.

When a final compensated value for the first light profile value ML and the input grayscale value is h, the final compensated value h may be determined as $h=g*x$. The final compensated value h is the multiplication of the input grayscale value and the compensation gain g.

As explained above, the grayscale gain of the first comparative embodiment for the light profile value ML may have a uniform value (e.g. two) regardless of the grayscale value. The grayscale gain of the second comparative embodiment for the light profile value ML may have a uniform value (e.g. 1.5) regardless of the grayscale value. In contrast, as shown in FIG. 18, the grayscale gain of the present exemplary embodiment may be varied according to the grayscale value when the light profile value ML is uniform (e.g., constant). For example, when the light profile value ML is uniform (e.g., constant) and the grayscale value increases, the grayscale gain of the present exemplary embodiment decreases. When the light profile value ML is uniform (e.g., constant), the pixel having the grayscale value of zero may be compensated by the grayscale gain of about 2.5 and the pixel having the grayscale value of 255 may be compensated by the grayscale gain of about 1.5.

In FIG. 14, the original image is compensated by the gain varied according to the grayscale value for the light profile value ML. The average grayscale value of the original image before local dimming is 71 and the average grayscale value of the display image compensated by the gain varied according to the grayscale value after local dimming using the light profile value ML is 46 which is greater than the average grayscale value of 44 of FIG. 13. In the luminance important area, the input grayscale value is compensated by the gain greater than the gain (e.g. 1.5) of FIG. 13 determined regardless of the input grayscale value so that the luminance important area in the present exemplary embodiment may have the luminance greater than the luminance of the luminance important area of FIG. 13. In addition, in the detail important area, the input grayscale value is compensated by the gain similar to the gain (e.g. 1.5) of FIG. 13 determined regardless of the input grayscale value so that the detail important area in the present exemplary embodiment may represent the detailed shape of the cloud similar to the detail important area of FIG. 13.

When the light profile value is uniform and the pixels in the display block represents various grayscale values, the grayscale gain corresponding to each pixel may be determined by comparing the input grayscale value of the pixel in the display block and the data voltage outputted to the pixel. For example, the data voltage may be an output of a buffer of the data driver 500. For example, the data voltage may be a voltage applied to the data line DL of the display panel 100.

According to the present exemplary embodiment, the light source part BLU is driven in the local dimming method according to the input image data IMG so that a power consumption of the display apparatus may be reduced. In addition, the input image data IMG may be compensated using the gains varied according to the grayscale values. Thus, the grayscale saturation is reduced or prevented in the high luminance region and the luminance is sufficiently compensated in the low luminance region so that the display quality of the display panel may be enhanced when using the local dimming method.

According to the present inventive concept as explained above, the power consumption of the display apparatus may be reduced and the display quality of the display panel in the low grayscale range may be enhanced.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

The terminology used herein is for the purpose of describing particular embodiments only and is not intended to be limiting of the inventive concept. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Further, the use of "may" when describing embodiments of the inventive concept refers to "one or more embodiments of the inventive concept." Also, the term "exemplary" is intended to refer to an example or illustration.

As used herein, the term "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

The electronic or electric devices and/or any other relevant devices or components according to embodiments of the present disclosure described herein, such as, for example, an external controller, a timing controller, power management circuit, a data driver, and a gate driver, may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of ordinary skill in the art should recognize that the functionality of various computing/electronic devices may be combined or integrated into a single computing/electronic device, or the functionality of a particular computing/electronic device may be distributed across one or more other computing/electronic devices without departing from the spirit and scope of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A display apparatus comprising:

a local dimmer configured to generate a dimming signal representing a degree of dimming for a light source block based on input image data;

an image compensator configured to determine a grayscale gain based on input grayscale value of the input image data and the dimming signal and to compensate luminance of the input image data based on the grayscale gain;

a display panel configured to display an image based on the compensated input image data; and a light source configured to provide light to the display panel based on the dimming signal, wherein the local dimmer is configured to generate first compensation information corresponding to a first gain graph having gains varied according to light profile values, wherein the image compensator is configured to generate a plurality of selecting compensation information groups corresponding to a plurality of selecting gain graphs having gains varied according to the light profile values for a plurality of selecting grayscale values, and wherein a gain of a first selecting gain graph corresponding to a first selecting grayscale value for a first light profile value is greater than a gain of a second selecting gain graph corresponding to a second selecting grayscale value greater than the first selecting grayscale value for the first light profile value.

2. The display apparatus of claim 1, wherein as the light profile value increases, the gain decreases in the first gain graph.

3. The display apparatus of claim 1, wherein as the light profile value increases, the gain decreases in each of the plurality of selecting gain graphs.

4. The display apparatus of claim 1, wherein the image compensator is configured to generate a plurality of additional compensation information groups corresponding to a plurality of compensation gain graphs corresponding to the plurality of the selecting grayscale values, and wherein, for the same light profile value and for the same grayscale value, multiplication of the gain of the first gain graph and the gain of the compensation gain graph is equal to the gain of the selecting gain graph.

5. The display apparatus of claim 4, wherein when the input grayscale value is between a first selecting grayscale value and a second selecting grayscale value, the input grayscale value is x, the first selecting grayscale value is s1, the second selecting grayscale value is s2, and a rate of change of grayscale value is e, $e=(x-s1)/(s2-s1)$.

6. The display apparatus of claim 5, wherein when a first compensation gain of a first compensation gain graph for the first light profile value is a, a second compensation gain of a second compensation gain graph for the first light profile value is b, and a rate of change of compensation is f, $f=(a-b)*e$, wherein when a rate of compensation of a pixel for the first light profile value and the input grayscale value is g, $g=b+f$, and wherein when a final compensated value for the first light profile value and the input grayscale value is h, $h=g*x$.

7. The display apparatus of claim 1, further comprising:

a gate driver configured to output a gate signal to the display panel;

a data driver configured to output a data voltage to the display panel;

a driving controller configured to control a driving timing of the gate driver and the data driver; and a host configured to output the input image data and an input control signal to the driving controller, wherein the host comprises the local dimmer, and the driving controller comprises the image compensator.

8. A method of driving a display apparatus, the method comprising:

generating a dimming signal representing a degree of dimming of a light source block based on input image data;

determining a grayscale gain based on input grayscale value of the input image data and the dimming signal;

compensating luminance of the input image data based on the grayscale gain;

displaying an image based on the compensated input image data; and providing light to a display panel based on the dimming signal, wherein the generating the dimming signal comprises generating first compensation information corresponding to a first gain graph having gains varied according to light profile values, wherein the determining the grayscale gain comprises generating a plurality of selecting compensation information groups corresponding to a plurality of selecting gain graphs having gains varied according to the light profile values for a plurality of selecting grayscale values, and wherein a gain of a first selecting gain graph corresponding to a first selecting grayscale value for a first light profile value is greater than a gain of a second selecting gain graph corresponding to a second selecting grayscale value greater than the first selecting grayscale value for the first light profile value.

9. The method of claim 8, wherein as the light profile value increases, the gain decreases in the first gain graph.

10. The method of claim 8, wherein as the light profile value increases, the gain decreases in each of the plurality of selecting gain graphs.

11. The method of claim 8, wherein the determining the grayscale gain further comprises generating a plurality of additional compensation information groups corresponding to a plurality of compensation gain graphs corresponding to the plurality of the selecting grayscale values, and wherein, for the same light profile value and for the same grayscale value, multiplication of the gain of the first gain graph and the gain of the compensation gain graph is equal to the gain of the selecting gain graph.

12. The method of claim 11, wherein when the input grayscale value is between a first selecting grayscale value and a second selecting grayscale value, the input grayscale value is x, the first selecting grayscale value is s1, the second selecting grayscale value is s2, and a rate of change of grayscale value is e, $e=(x-s1)/(s2-s1)$.

13. The method of claim 12, wherein when a first compensation gain of a first compensation gain graph for the first light profile value is a, a second compensation gain of a second compensation gain graph for the first light profile value is b, and a rate of change of compensation is f, $f=(a-b)*e$, wherein when a rate of compensation of a pixel for the first light profile value and the input grayscale value is g, $g=b+f$, and wherein when a final compensated value for the first light profile value and the input grayscale value is h, $h=g*x$.

* * * * *